US005085479A

United States Patent [19]

Taylor

[11] Patent Number: 5,085,479

[45] Date of Patent: Feb. 4, 1992

[54] VERTICALLY MANIPULATED RATCHET FISHING TOOL

[76] Inventor: William T. Taylor, Rte. #2, Box 1542, Warren, Tex. 77664

[21] Appl. No.: 375,667

[22] Filed: Jul. 5, 1989

Related U.S. Application Data

[63] Continuation-in-part of Ser. No. 276,889, Nov. 28, 1988, abandoned, and a continuation-in-part of Ser. No. 256,592, Oct. 13, 1988, abandoned.

[51] Int. Cl.[5] ..... E21B 31/18; E21B 31/20

[52] U.S. Cl. ..... 294/86.17; 294/86.25; 294/86.3

[58] Field of Search ..... 294/86.17, 86.19, 86.2, 294/86.25, 86.26, 86.3, 86.32, 86.33, 86.34

[56] References Cited

U.S. PATENT DOCUMENTS

| | | | |
|---|---|---|---|
| 2,745,693 | 5/1956 | McGill | 294/86.3 |
| 2,893,491 | 7/1959 | Crowe | 294/86.34 |
| 3,020,081 | 2/1962 | Patterson | 294/86.3 |
| 3,321,017 | 5/1967 | Young | 294/86.34 |
| 3,638,988 | 2/1972 | Brown | 294/86.25 |
| 4,093,294 | 6/1978 | Taylor | 294/86.25 |
| 4,124,245 | 11/1978 | Kuenzel | 294/86.3 |
| 4,185,865 | 1/1980 | Taylor | 294/86.3 |

FOREIGN PATENT DOCUMENTS

| | | | |
|---|---|---|---|
| 2184760 | 7/1987 | United Kingdom | 294/86.26 |

*Primary Examiner*—Johnny D. Cherry
*Assistant Examiner*—Dean J. Kramer
*Attorney, Agent, or Firm*—Matthews & Assoc.

[57] ABSTRACT

A ratcheting fishing tool having a generally cylindrical body connected with and housing a rotary ratcheting device along with an operating shaft axially mounted to reciprocate within the body and also connected to the ratcheting device. A fish grappling apparatus, having a first element connected to the housing and a second element connected to the shaft, operates to grasp a fish with the operating shaft being in a first axial position with respect to the housing and to be free of the fish with the operating shaft being in a second axial position. The ratcheting mechanism is adapted to be axially moved successively against a spring return with each movement actuating the rotary ratchet to latch the operating shaft alternately in a first axial position and in a second axial position. Ratcheting fishing tool is disclosed in an overshot fishing tool embodiment and a spear fishing tool embodiment.

7 Claims, 4 Drawing Sheets

10
12
14
16
20
18
22
26
24A
30
28
102
24
110
122
24B
32
35
34

35
34
46
44
40
36
42
38
54

42
38A
48
52
50
54

VERTICALLY MANIPULATED RATCHET FISHING TOOL

BACKGROUND OF THE INVENTION

This application is a continuation in part of co-pending application Ser. No. 276,889, filed Nov. 28, 1988, for RATCHETING SPEAR FISHING TOOL now abandoned co-pending application Ser. No. 256,592, filed Oct. 13, 1988, for RATCHETING OVERSHOT FISHING TOOL now abandoned.

This invention generally pertains to methods and apparatus for retrieving objects, generally termed "fish", from well bores.

More specifically, the invention pertains to a fishing tool which incorporates a rotary ratcheting mechanism which ratchets, in response solely to successive vertical movements of the tool, to grasp the fish with a first downward movement of the tool as positioned with the fish, and alternately to release the fish with a succeeding downward movement of the tool relative to the fish.

The presently known prior art consists of the following patents: Miller U.S. Pat. No. 1,785,590; McGill U.S. Pat. No. 2,745,693; Crowe U.S. Pat. No. 2,893,491; Bross U.S. Pat. No. 2,916,014; Lee et al U.S. Pat. No. 3,108,637; Hechle U.S. Pat. No. 3,288,115; Levoin U.S. Pat. No. 2,289,638; Patterson U.S. Pat. No. 3,020,081; Young U.S. Pat. No. 3,321,017; Timmons U.S. Pat. No. 3,380,528; Bostock U.S. Pat. No. 3,628,822; Brown U.S. Pat. No. 3,638,988; Miller et al U.S. Pat. No. 3,652,173; Kaercher U.S. Pat. No. 3,758,146; Ganz U.S. Pat. No. 3,792,931; Taylor U.S. Pat. No. 4,093,294; Richey U.S. Pat. No. 4,101,157; Kuenzel U.S. Pat. No. 4,124,245; Taylor U.S. Pat. No. 4,185,865; and Crawford U.S. Pat. No. 4,682,657. Also, U.K. (July 1, 1987) No. 2,184,760A.

The up and down movements of this tool when grasping and releasing a fish somewhat resembles the function of clicker type ball point pens. Consequently, the references listed above include some of the writing instrument mechanisms which were uncovered and which illustrate different types of ratcheting mechanisms. Though similar in function, none of these writing instrument mechanisms as shown would appear to be suitable for use in the present invention.

The present tool may be provided in several sizes from a size sufficiently small to be used through well tubing (such as $1\frac{7}{8}''$ O.D.) to the large sizes suitable for use with drill pipe and drill collars (such as $5\frac{3}{4}''$ O.D.). The operating string for the tool may be a wire line, the "spaghetti" used through well tubing and drill pipe. The tool is adapted to conduct fluids or electrical conductors as may be needed.

The tool may be utilized in conjunction with a well jar and a jar accelerator as may become desirable.

The operation of this invention as used is very simple and reliable. The operator needs only to bring the grasping element sufficiently down with respect to the fish for the upper end of the fish to actuate the ratchet mechanism of the tool. The tool readily grasps the fish and retains its grasp as long as tension is applied to the tool.

OBJECTS OF THE INVENTION

The principal object of the present invention is to provide a fishing tool which is reliable and simple to operate.

Another object of the present invention is to provide a fishing tool which is of less length and which has fewer parts than comparable fishing tools.

Another object of the present invention is to provide a fishing tool which is compact, rugged, and capable of extended use without repair.

SUMMARY OF THE INVENTION

The foregoing and other objects and advantages of the present invention are provided in a ratcheting fishing tool having a generally cylindrical body connected with a rotary ratcheting mechanism along with an operating shaft axially mounted to reciprocate within the body and also connected to the ratcheting mechanism. A fish grappling apparatus having a first element connected to the housing and a second element connected to the shaft operates to grasp a fish with the operating shaft being in a first axial position with respect to the housing and to be free of the fish with the operating shaft being in a second axial position. The ratcheting mechanism is adapted to be axially moved successively against a spring return with each movement actuating a rotary ratchet to latch the operating shaft alternately in a first axial position and in a second axial position. The ratcheting mechanism includes a cam guide connected as part of the operating shaft and having a plurality of splines mounted in axially movable splined relation in corresponding grooves formed within the body. A ratchet member is mounted in axially moveable relation on the shaft and has a plurality of ratchet splines adapted to slide into the grooves adjacent to the cam splines when the ratchet splines are rotationally aligned with the cam splines. The cam guide and the ratchet member each has a circular set of ratchet teeth with each tooth of the teeth having a sliding ramp and a stop face. The cam splines are aligned with alternate ratchet teeth of the cam guide and the ratchet splines are aligned with alternate teeth of the ratchet member. A flexible spring is adapted to maintain and return the shaft and the cam guide to a first position each time the shaft is moved from the first position to a second position and returned. The ratchet teeth slide along the cam teeth to rotate the ratchet member one tooth around the cam each time the shaft and the cam are moved from and returned to the first position. The ratchet teeth and the cam teeth are defined about an inner radius and coincident with the spline teeth and the body teeth which are defined about an outer radius.

BRIEF DESCRIPTION OF THE DRAWING

FIGS. 5-10 are not used in this specification;

DESCRIPTION OF A PREFERRED EMBODIMENT

Figures 1A, 1B, 2:
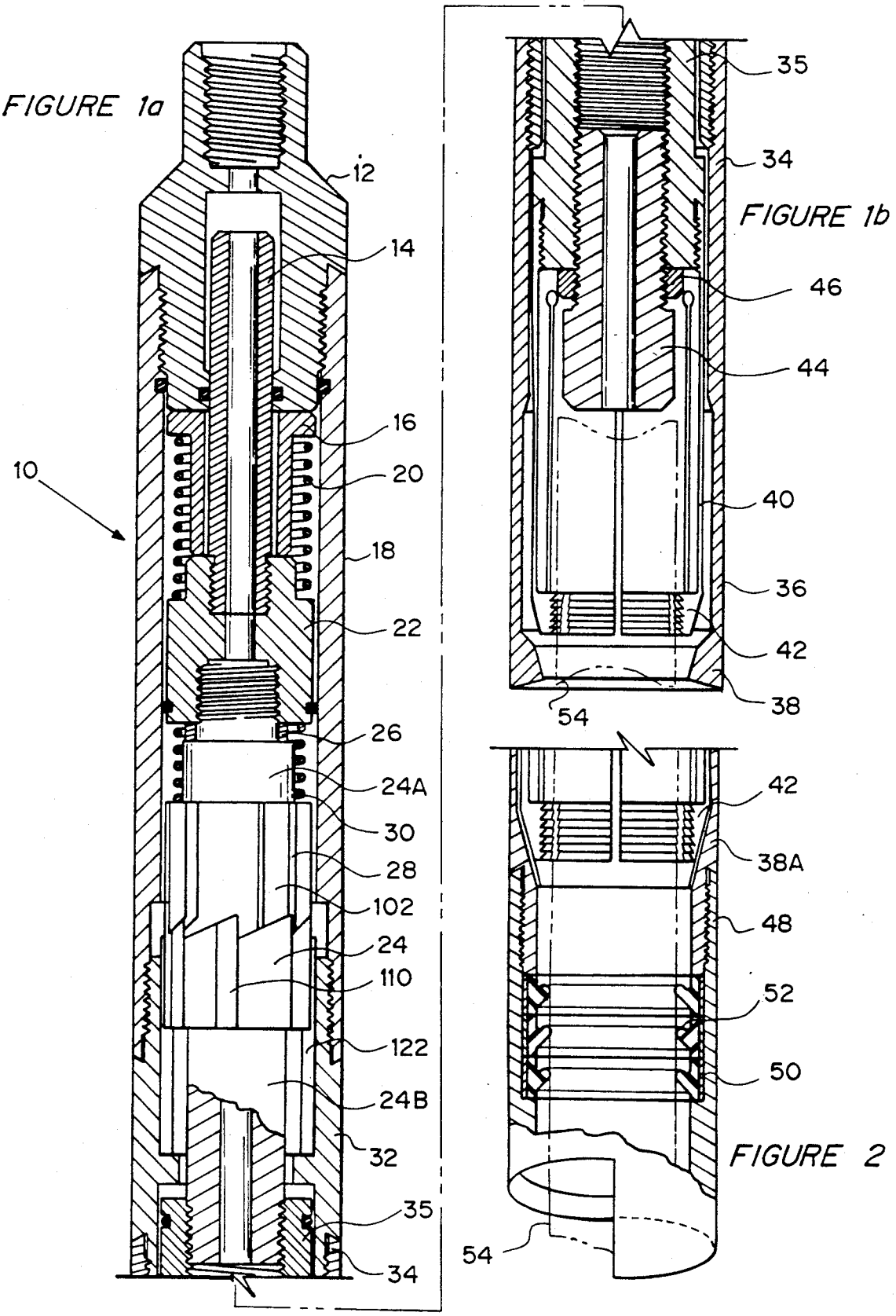
FIGS. 1A and 1B constitute a longitudinal cross-sectional view of an overshot fishing tool with the overshot placed down over the upper end of a fish but not yet grasping the fish.
FIG. 2 is a view similar to FIG. 1B and additionally shows a fluid seal extension sub containing a lip seal for pumping fluids down through the fishing tool and into the fish without loss of the fluid.

Referring jointly to FIGS. 1A and 1B there is shown a complete tool 10 as brought down and placed on a "fish" 54. Of note is that FIGS. 1A and 1B are somewhat schematic in nature and are not to scale. The diameter of the tool 10 as shown is expanded with respect to its length for clarity. The tool is operable as shown.

Beginning at the top of tool 10, the tool is seen to include a top sub 12 connected into a housing 18. A wash pipe 14 extends upwardly through the sub 12 and down into threaded engagement with an upper connector 22. A spring centering sleeve 16 is disposed between connector 12 and the upper connector 22 which guides a compressed coiled spring 20. In threaded connection with the upper connector 22 is a cam guide 24 including a ratchet cam 24, an upper shaft 24A and a lower shaft 24B. Mounted above the cam guide 24 is a ratchet member 28 urged down against the cam 24 by means of a separator spring 30 and a thrust washer/bearing 26.

The housing 18 is seen to be threadedly connected to a cam body 32 which has spline grooves 122 to accommodate the splines 110 on the cam guide 24, as later described.

The cam body 32 is in threaded connection with a grapple sub 34 which extends downwardly to threadedly connect into a grapple body 36 which terminates in an internally tapered grapple bowl 38. An internal grapple sub 35 is connected to the bottom of the shaft 24B at its upper end and in threaded connection with an adjustable spacer 44 having a lock nut 46 as later described. A grapple collet 40 is connected in threaded connection to the lower end of the sub 35.

The grapple collet terminates at its lower end with externally tapered grapple fingers 42 having internal wicker teeth which are adapted to fit into and be compressed by downward movement in the grapple bowl 38. As seen, the function of the adjustable spacer 44 is to limit the downward travel of the tool 10 over the fish 54 to where further downward force on the tool 10 through the spacer 44 serves to actuate the ratcheting mechanism as later described.

It is seen that the moving parts of the tool 10 with respect to the fish 54, which comprise a body or housing, are the members 12, 18, 32, 34, and 38. The stationary parts, which comprise an operating shaft or mandrel, remain stationary with respect to the fish 54 and include the spacer 46, the internal grapple sub 35, the cam guide 24 including mandrels 24B and 24A, the upper connector 22 and the wash pipe 14.

While the outside moveable parts of tool 10 move downwardly with respect to the fish 54, and the internal parts as enumerated remain stationary with respect to the fish 54, the description of the operation of the ratcheting mechanism will be made as describing the internal ratchet mechanism as moving upwardly and downwardly within the housing 18.

An alternate embodiment of tool 10, which replaces FIG. 1B, is shown in FIG. 2 of the drawing. In this embodiment all the parts are the same excepting that the bowl 38 is modified to fit with a fluid seal extension 48 which carries a seal recess seat 50 containing a plurality of lip seals 52 which are bonded into metal supporting rings as shown. The purpose of this alternate embodiment is to permit fluids to be pumped down through the tool from the top sub 12, into the fish 47 while preventing leakage of fluids from the top of the fish 47 into the surrounding well bore.

In a further embodiment (not shown) a conical packer element may be attached to the spacer 44 to extend into the fish 54 for providing a fluid seal in the event that the end of the fish can not be sealed by the seals 52.

Figure 3:
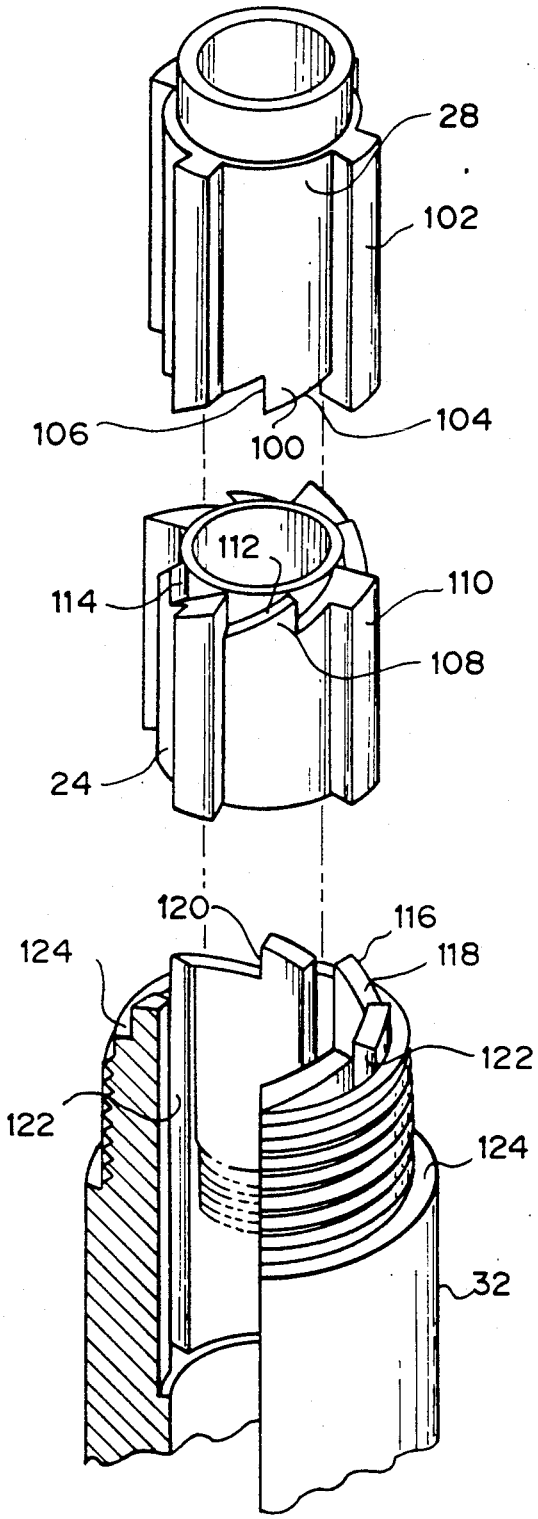
FIG. 3 is an isometric exploded view of the ratcheting mechanism of FIG. 1A showing various features of the mechanism components in detail.

Referring now to FIG. 3, there is shown an exploded isometric view including the cam body 32, cam guide 24, and the ratchet member 28. The spring 30 (not shown) urges the ratchet member 28 downwardly toward the guide cam 24 and the guide cam 24 is urged downwardly along the shaft 24A through the upper connector 22 by the spring 20 as seen in FIG. 1A. It is noted that downward movement of the housing 18 and the grapple body 36 operate to selectively compress both springs further.

The ratchet member 28 is seen to be formed with a plurality of downwardly extending ratchet teeth 100. In the instance of the present embodiment, there are eight teeth 100 on the ratchet member 28. Each of the ratchet teeth 100 is seen to be formed with an inclined ramp 104 terminating in a ratchet face 106. Ratchet member 28 is also formed with a plurality of splines 102 which extend down at a greater radius to merge into alternates ones of the teeth 100 such that the face 106S of alternate teeth are common with a side of the spline 102 and the lower end 104S of the spline 102 is common with the ramp 104 of alternate teeth 100. In the present instance, the ratchet body 28 has four equally spaced splines 102.

The guide cam 24 is formed with an upper shaft 24A and a lower shaft 24B as previously described with reference to 1A. In this view the shafts 24A and 24B are shown in phantom to clarify the other elements of the drawing.

Guide cam 24 is seen to be formed with a plurality of upwardly extending teeth 108 and a plurality of splines 110 of greater radius than teeth 108. In this instance, there are eight teeth 108 and four splines 110 formed with alternate teeth 108. The splines 108 are seen to be formed with ramps 112S and cam faces 114S with the upper ends of the splines 110 forming the portion 112S of the ramps 112 and a portion of the faces 114 for purposes later evident with the operation of this apparatus.

The cam body 32 is seen to include a plurality of upwardly extending cam body teeth 116 with each tooth 116 being formed with a cam body ramp 118S and a cam body face 120. As shown, there are a plurality of spline grooves 122 which are formed between alternate teeth 116 such that the alternate cam body faces 120S are common with a side of the cam body grooves 122. The end of the cam body 32 has also been machined to form a shoulder face 124.

It is to be noted that the ramps 118 and faces 120S have the same radius as the ramps 112S and faces 114S and also as the ramps 104S, and faces 106S. It is also noted that the ramps 104, faces 106, ramps 112, faces 114 are of the same radius.

The upper end of cam body 32 is formed with the recessed shoulder face 124 such that each of the teeth 116 extend upwardly. As later described, the cam body ramps 118S encounter the spline portion 104S of the ramps 104 of the ratchet member 28. The guide cam 24 and its associated mandrels 24A and 24B are urged downwardly by the spring 20 such that the splines 110 fit down into the spline grooves 122 and reach the bottom of the spline grooves.

It is to be noted that the teeth ramps 104 of the ratchet member 28 and the ramps 112 are of corresponding length with the splines 102 and 110 being in the same rotational phase so that the splines 102 are able to slide down the face of spline 110 and onto the teeth faces 118.

It is also to be noted (with reference to FIG. 4) that the spline grooves 122 replace a part of cam body teeth 116. The body teeth 116 are rotationally offset from teeth 100 and 108 by a distance of one-half (½) the length of It is further to be noted that guide cam teeth 108S are in contact only with ratchet teeth 100S. The ramps 118S are in contact only with the ramps 104S and the ramps 104.

The first position of the operating shaft is when the spline member 102 of ratchet member 22 are disposed within the spline grooves 122 along with the splines 110 of guide cam 20. Next, the guide cam teeth 108 push the ratchet teeth 100 out far enough for the splines 102 to clear the cam body teeth 116. The ratchet teeth 100 slide down off the teeth 108 onto the teeth 116 until the teeth 100 are stopped by the faces of teeth 108. Then, as the guide cam teeth 108 are absent, the teeth 100 slide on down the teeth 116 until stopped by the faces of teeth 116. This is the second position of the operating shaft. Next, the guide cam teeth 108 are again extended from the cam body teeth 116. Then, the teeth 100 slide off a portion of teeth 108 onto a ramp portion of succeeding teeth 116 until the teeth 100 come into contact with the faces of teeth 108. When the guide cam teeth 108 are again absent, the teeth 100 slide down a portion of teeth 116 until the splines 102 are again in registry with the spline grooves 122. The operating shaft is thereon moved back to the first position.

Thus, when the ratchet cam 24 is moved upwardly and carries the ratchet member 28 upwardly, the ramps 108 are midway along the ramps 112 of the ratchet cam, and the ramps 108 against ramp 112 urge the ratchet member to rotate. As the ratchet cam 24 is moved down, the ramps 118 against ramps 108 urge the ratchet member into further rotation until the stop faces 106 of the ratchet teeth 100 are in abutment with the stop faces 120 of the cam body.

The cam guide 24 remains inside the cam body 32 with the splines 110 positioned within the spline slots 122. If the splines 102 are registered in alignment with the splines 122, then spring 30 urges the ratchet member 28 down until the ramp surface 104 of each spline 106 is abutting the ramp surface 118 of the spline 110.

Movement of the body 18 downwardly with respect to the inner assembly (which is supported by the abutment of the fish 54 with the spacer stop 44) creates more compressive tension in the spring 20.

Consequently, the cam guide 24 comes upwardly within the cam body 32 and pushes upwardly against the ratchet member 28 forcing the ratchet member 28 upwardly until the splines 102 are free of the faces 120 of the slots 122. At this time the faces 104 of the splines 106 are urged to slide down the faces 112 of the splines 110 and the ratchet member 28 is thereon rotated until the face 106 of the splines 102 comes into abutment with the face 114 of the teeth 116. At this position the splines 102 are prevented from re-entering the spline grooves 122 as the spring 30 expands to bring the cam guide member 24 back into its lower most position.

The ratchet member 28 remains in an upper position supported by the faces 104 of the teeth 100 where the faces 104 of the splines 106 cannot re-enter the spline grooves 122. In this position the externally tapered grapple fingers 42 are withdrawn from the grapple bowl 38 and the collet is in released position from the fish 54.

When the body 18 is next moved downwardly to compress the spring 20, it moves the cam guide 24 downwardly from contact with the ratchet member 28. As this second downward force on body 18 is released, the body again moves upwardly. The cam guide 24 again comes upwardly into contact with the ramp face 100 of the ratchet member 28.

As the cam guide 24 is being pushed down the body 18 through the spring sleeve 16 and the upper connector 22, the spring 30 is urging the ratchet member 28 downwardly and the alignment of the teeth 104 with the teeth 108 causes a portion of the ramp 104 to be in contact with the ramp 118 and thereby cause the spring 30 to rotate the member 28 as the cam surface 104 slides down the cam surface 118. This rotating action again places the spline 102 in registry with the spline 110 such that the spline 102 moves downwardly into the spline groove 122.

As the spline 102 moves into the cam groove 122 with the spline 110, the spring 30 may then push the upper connector 22 and the cam guide 24 downwardly. This downward movement of the cam guide 24 also moves the collet sub 35 and the tapered fingers 42 into compression with the bowl taper 38 to cause the fingers 42 to firmly grasp the fish 54. The fish 54 may be pulled upwardly with an upward pull of the top sub 12 from an operating string in the well bore.

The foregoing is more specifically described with reference to FIG. 4.

Figure 4:
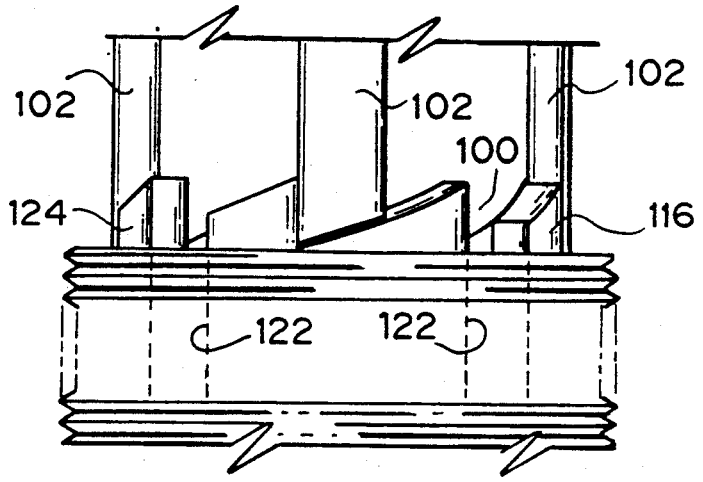
FIG. 4 is an elevational, partly schematic, view of the ratcheting elements of FIG. 3.

In FIG. 4 the cam guide 24 is on its way down with ratchet member 28 following. The splines 102 are supported by the cam body teeth 116.

As the cam guide 24 again moves up within the cam body 32, the cam surface 104 is pushed up by cam surface 108 and causes the surface of spline 102 to slide down the cam surface 112 until the spline surface 104 slides down ramp 120 of cam body teeth 116 to where the face 106 of spline 102 is abutting faces 120 of teeth 116 as shown in FIG. 4.

OPERATION OF THE OVERSHOT EMBODIMENT

In operation, the tool 10 is lowered by means of an operating string into position for placement over the top of the fish 54. Depending on the size of the tool 10 and well conditions, the operating string may be a wire line. In other applications the operating string may be the spaghetti which can be run down inside tubing. In still other operations, well tubing may be the operating string to take the tool 10 down with the casing. In open hole conditions where there is no casing in the well, the tool may be adapted to be connected to the lower end of drill collars by the conventional tapered threads of drill pipe. The tool 10 is usually operated in conjunction with a conventional well jar such as shown in the prior art. Above the well jar is generally one or more sections of sinker bar or drill collars to provide mass for inertia. Above the mass is a jar accelerator tool which may be conventional, or a new type such as shown in Ser. No. 217,447, filed July 11, 1988.

The tool 10 is brought down over the fish 54 until the spacer 44 is in contact with the fish. Additional weight is then put down on the tool 10 to move the cam guide 24 as above described. The tool 10 is then raised slightly. The lowering and raising permits the internal ratchet to operate and to cause the fingers 42 to extend into the taper of the bowl 38 and grip the pipe firmly so that the fish can be hoisted up and removed from the well.

If for some reason the fish 54 does not readily come out in response to pulling on the fish by the tool 10, the tool may again be lowered to permit the spacer 46 to actuate the internal ratchet to cause the ratchet to remain in its upper position and release the fingers 42 from about the fish.

In some instances it is desirable for the tool 10 to be equipped with the fluid seal extension 48 to permit pumping of fluids down through the tool 10 and into the fish. Under some conditions the fluid pumped into the fish causes circulation below the fish and facilitates its removal.

DESCRIPTION OF AN ALTERNATE PREFERRED EMBODIMENT

Figure 11A:
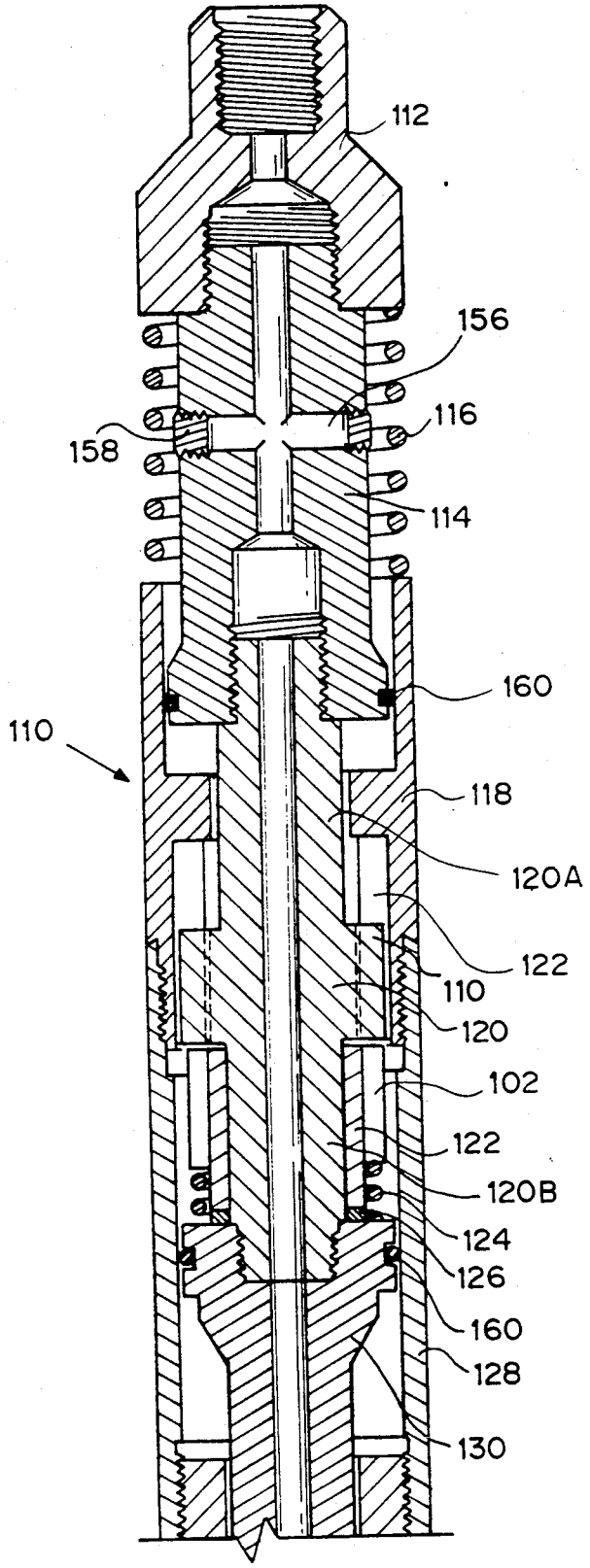
FIGS. 11A and 11B constitute a longitudinal cross-sectional view of a spear fishing tool with the spear placed down into the upper end of a fish but not yet grasping the fish.
Figure 11B:
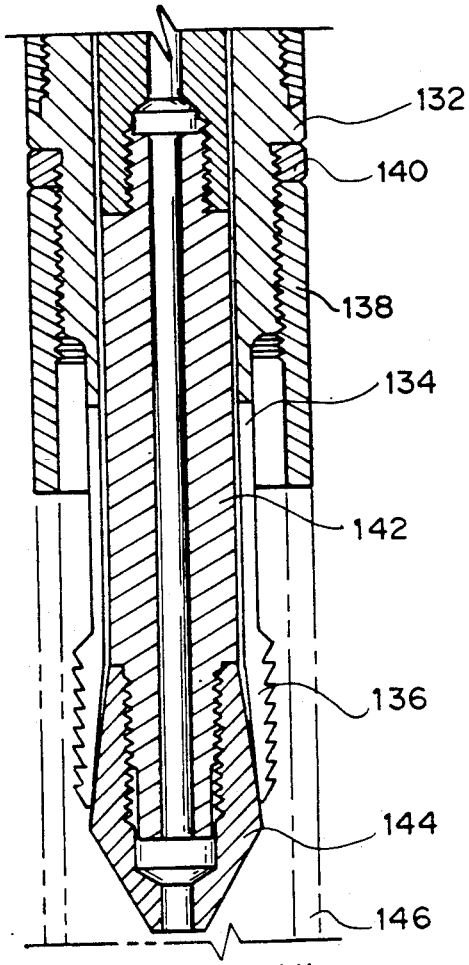

Referring jointly to FIGS. 11A and 11B, there is shown a complete tool 110 as brought down and placed into a "fish" 146. Of note is that FIGS. 11A and 11B are somewhat schematic in nature and are not to scale. The diameter of the tool 110 as shown is expanded with respect to its length for clarity. The tool is operable as shown.

Beginning at the top of tool 110 there is shown a top sub 112 connected onto an upper shaft mandrel 114. The mandrel 114 extends downwardly into an upper housing body 118 to be threadedly connected to the upper cam shaft 120A of a cam guide 120. A compressed coil spring 116 is mounted between the sub 112 and the housing body 118. The cam shaft 120A is part of the cam guide 120.

Cam guide 120 has guide splines 210 which are slidingly mounted in spline grooves 222 which are formed in the body 118. The cam guide 120 has a lower shaft 120B which extends downwardly within a cam body extension 128 into connection with a cam bolt connector 130. Mounted to reciprocate and rotate on cam shaft 120B is a ratchet member 122. Ratchet member 122 is biased into contact with cam guide 120 by a compressed coil separator spring 124. A thrust washer/bearing 126 is mounted between the ratchet member 122 and the cam bolt connector 130.

The extension body 128 is connected to a spear slip 132 having a plurality of slip fingers 134 which terminate with finger tips 136. The finger tips 136 have internal tapered surfaces and external wicker teeth, as shown.

An adjustable spacer collar 138 is adjustably connected onto the spear slip 132 and locked into position with a threaded collar lock 140. The purpose of the spacer collar 138 is to allow the slip fingers 134 to extend a designated distance into the open end of the fish 146 when the collar 138 comes into abutment with the upper end of the fish 146.

The cam bolt connector 130 is threadedly connected through a cone mandrel 142 into connection with a slip expansion nose cone 144. The nose cone 144 is fitted inside the tapered surfaces of the fingertips 136 such that the fingertips are expanded into gripping contact within the fish 146 when the bolt connector 130 and the cam guide 120 are moved upwardly with respect to the body 118 and the spacer collar 138. The fingertips 136 retract due to the spring action of fingers 134 when the cone 130 is moved downwardly with respect to the collar 138 and the fingers 134.

It is seen that the moving parts of the tool 110 with respect to the fish 146, which comprise an operating shaft, are the members 112, 114, 120A, 120, 120B, 130, 142, and 144. The stationary parts, which comprise an operating housing body, remain stationary with respect to the fish 54 and include the body 118, the extension body 128, the spear slip 132, and the spacer collar 138.

The description of the operation of the rotary ratcheting mechanism will be made describing the internal ratchet mechanism as moving upwardly and downwardly within the housing 118.

Figure 12:
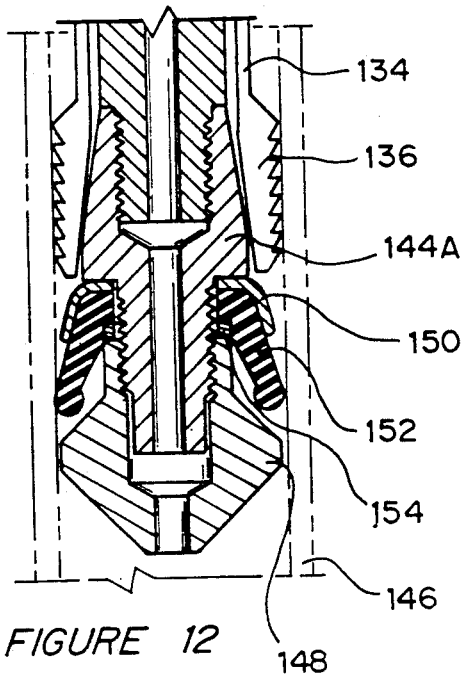
FIG. 12 is a view similar to FIG. 11B and additionally shows a fluid seal extension sub containing a cup seal for pumping fluids down through the fishing tool and into the fish without loss of the fluid.

An alternate embodiment of tool 110, which replaces FIG. 11B, is shown in FIG. 12 of the drawing. In this embodiment all the parts are the same excepting that nose cone 144 is replaced with a fluid seal nose cone 144A which carries sealing packer cup 152. A packer cup back up 150, the packer cup 152 and packer cup retainer 154 are connected to the nose cone 144A by threaded connection of a packer retainer cone 148 as shown. As shown in FIG. 11A, the pressure equalizing ports 156 are closed with plugs 158 in this instance. The purpose of this alternate embodiment is to permit fluids to be pumped down through the tool from the top sub 112 into the fish 146 while preventing leakage of fluids from the top of the fish 146 into the surrounding well bore.

Figure 13:
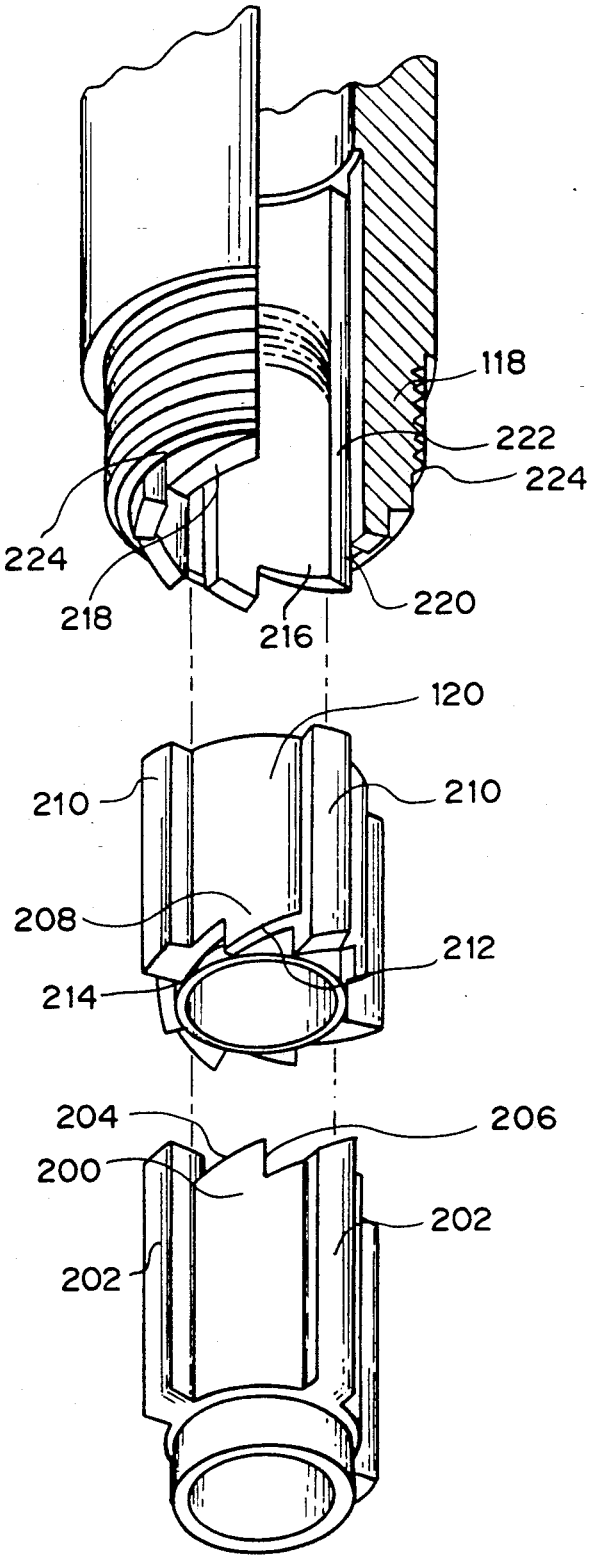
FIG. 13 is an isometric exploded view of the ratcheting mechanism of FIG. 11A showing various features of the mechanism components in detail.

Referring now to FIG. 13, there is shown an exploded isometric view including the cam body 118, cam guide 120, and the ratchet member 122. The spring 124 urges the ratchet member 122 upwardly toward the cam guide 120 and the cam guide 120 is urged upwardly through the shaft 120A and the upper mandrel 114 by the spring 116 (as seen in FIG. 11A). It is noted that downward movement of the operating shaft operates to selectively compress both springs further.

The ratchet member 122 is seen to be formed with a plurality of upwardly extending ratchet teeth 200. In the instance of the present embodiment, there are eight teeth 200 on the ratchet member 122. Each of the ratchet teeth 200 is seen to be formed with an inclined ramp 204 terminating in a ratchet face 206. Ratchet member 122 is also formed with a plurality of splines 202 which extend up to merge into alternates one of the teeth 200 such that the face 206 of alternate teeth are common with a side of the spline 202 and the upper end of the spline 202 is common with the ramp 204 of alternate teeth 200. In the present instance, the ratchet member 122 has four equally spaced splines 202.

The cam guide 120 is formed with an upper shaft 120A and a lower shaft 120B as previously described with reference to FIG. 11A. In this view the shafts 120A and 120B are shown in phantom to clarify the other elements of the drawing.

Cam guide 120 is seen to be formed with a plurality of downwardly extending teeth 208 and a plurality of splines 210. In this instance there are eight teeth 208 and four splines 210 formed with alternate teeth. The splines 208 are seen to be formed with ramps 212 and cam faces 214 with the lower ends of the splines 210 forming a portion of the ramps 212 and a portion of the faces 214 for purposes later evident with the operation of this apparatus.

The cam body 118 is seen to include a plurality of downwardly extending cam body teeth 216 with each tooth 216 being formed with a cam body ramp 218 and a cam body face 220. As shown, there are a plurality of spline grooves 222 which are formed between alternate teeth 216 such that the alternate cam body faces 220 are common with a side of the cam body grooves 222. The end of the cam body 118 has also been machined to form a shoulder face 224.

The lower end of cam body 118 is formed with the recessed shoulder face 224 such that each of the teeth 216 extend downwardly. As later described, the cam body ramps 218 encounter the spline portion of the ramps 204 of the ratchet member 122. The cam guide 120 and its associated mandrels 120A and 120B are urged upwardly by the spring 116 such that the splines 210 fit up into the spline grooves 222 at the top of the spline grooves or until such time as force is exerted downwardly to overcome the urging force of the spring 116.

It is to be noted that the teeth ramps 204 of the ratchet member 122 and the ramps 212 are of corresponding length with the ramps 204 and 212, and that the splines 202 and 210 are in the same rotational phase so that the splines 210 slide up onto the splines 202.

It is also to be noted (with reference to FIGS. 13 and 14) that the spline grooves 222 replace a part of cam body teeth 216. Also, the body teeth 216 are rotationally offset from teeth 200 and 208 by a distance of one-half (½) the length of a tooth.

It is further to be noted that cam guide teeth 208S are in contact only with ratchet teeth 200. The body teeth 216 are in contact only with the splines 202 ramps of the teeth 200.

The first position of the operating shaft is when the spline members 202 of ratchet member 122 are disposed within the spline grooves 222 along with the splines 210 of cam guide 120. Next, the guide cam teeth 208 push the ratchet teeth 200 out far enough for the splines 202 to clear the cam body teeth 216. The ratchet teeth 200 (splines 202 portion) slide off the teeth 208 onto the teeth 216 until the teeth 200 are stopped by the faces of teeth 208. Then, as the guide cam teeth 208 are retracted, the teeth 200 slide on up the teeth 216 until stopped by the faces of teeth 216. This is the second position of the operating shaft. Next, the guide cam teeth 208 are again extended from the cam body teeth 216. Then, the teeth 200 slide off a portion of teeth 208 onto a ramp portion of succeeding teeth 216 until the teeth 200 come into contact with the faces of teeth 208. As the guide cam teeth 208 are again retracted, the teeth 200 slide down a portion of teeth 216 until the splines 202 are again in registry with the spline grooves 222. The operating shaft is thereon moved back to the first position.

Thus, when the ratchet cam 120 is moved downwardly and carries the ratchet member 122 downwardly, the ramps 208 are midway along the ramps 212 of the ratchet cam and the ramps 208 against ramp 212 urge the ratchet member to rotate. As the ratchet cam 120 is moved up, the ramps 218 against ramps 208 urge the ratchet member 122 into further rotation until the stop faces 206 of the ratchet teeth 200 are in abutment with the stop faces 220 of the cam body 118.

The cam guide 120 remains inside the cam body 118 with the splines 210 positioned within the spline slots 222. If the splines 202 are registered in alignment with the splines 222, then spring 124 urges the ratchet member 122 up until the ramp surface 204 of each spline 202 is abutting the ramp surface 218 of the spline 210.

Movement of the operating shaft downwardly with respect to the inner assembly (which is supported by the abutment of the fish 146 with the spacer collar 138) creates more compressive tension in the spring 116.

Consequently, the cam guide 120 comes downwardly within the cam body 118 and pushes downwardly against the ratchet member 128, forcing the ratchet member 122 downwardly until the splines 202 are free of the faces 220 of the slots 222. At this time the faces 204 of the splines 202 are urged to slide up the faces 212 of the splines 210 and the ratchet member 122 is thereon rotated until the face 206 of the splines 202 comes into abutment with the face 214 of the teeth 216. At this position the splines 202 are prevented from re-entering the spline grooves 222 as the spring 116 expands to bring the cam guide member 120 back into its uppermost position.

The ratchet member 122 remains in a lower position supported by the faces 204 of the teeth 200 where the faces 204 of the splines 202 cannot re-enter the spline grooves 222. In this position the tapered retainer cone 144 is extended from the fingertips 136 and the fingers 134 are in released position from the fish 146.

When the operating shaft is next moved downwardly to compress the spring 116, it moves the cam guide 120 upwardly from contact with the ratchet member 122. As this second downward force on body 118 is released, the body again moves upwardly. The cam guide 120 again comes upwardly into contact with the ramp face 200 of the ratchet member 122.

As the cam guide 120 is being pushed down, the spring 124 is urging the ratchet member 128 upwardly and the alignment of the teeth 204 with the teeth 208 causes a portion of the ramp 204 to be in contact with the ramp 218 and thereby causes the spring 124 to rotate the member 122 as the cam surface 204 slides on the cam surface 218. This rotating action again places the spline 202 in registry with the spline 210 such that the spline 202 moves upwardly into the spline grooves 222.

As the splines 202 move into the cam grooves 222, the spring 124 may then push the cam guide 120 upwardly. This upward movement of the cam guide 120 also moves the expansion cone upwardly to cause the fingertips 136 to firmly grasp the fish 146. The fish 146 then may be pulled upwardly with an upward pull of the top sub 112 from an operating string in the well bore.

The foregoing is more specifically described with reference to FIG. 14.

Figure 14:
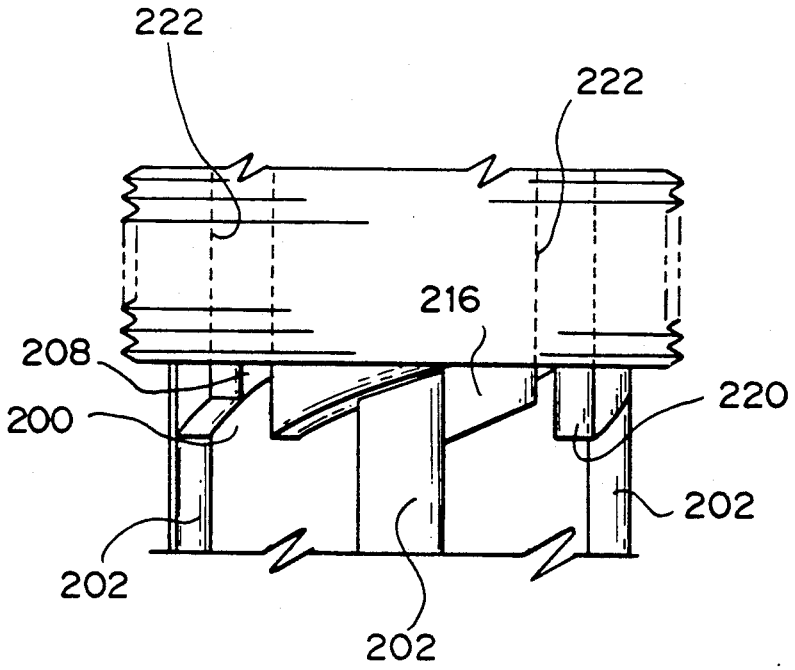
FIG. 14 is an elevational, partly schematic, view of the ratcheting elements of FIG. 13.

In FIG. 14, the spline 210 of cam guide 120 is on its way up with ratchet spline 202 following. The splines 202 are supported by the splines 210.

As the cam guide 120 again moves down within the cam body 118, the cam surface 204 is pushed down by cam surface 208 and causes the surface of spline 202 to slide up the cam surface 212 until the spline surfaces 204 slide up the ramps of cam body teeth 216 to where the faces 206 of splines 202 are abutting faces 220 of teeth 216 as shown in FIG. 14.

The term inner radius as used in the specification or claims means the mean radius of the teeth 100 and 108 in FIG. 3, for example, and teeth 200 and 208 in FIG. 13. The term outer radius means the mean radius of the teeth portions 104S of splines 102, the teeth portions 112S of splines 110 in FIG. 3, and the teeth 216 in FIGS. 3 and 4, and the corresponding teeth in FIGS. 13 and 14.

It is also noted, with reference to FIGS. 1A, 4, 11A and 14, that the tools 10 and 110 are shorter, more compact and have fewer components than conventional prior art tools.

OPERATION OF THE SPEAR EMBODIMENT

In operation, the tool 110 is lowered by means of an operating string (not shown) into position for placement into the top of the fish 146. Depending on the size of the tool 110 and well conditions, the operating string may be a wire line. In other applications, the operating string may be the spaghetti which can be run down inside tubing. In still other operations, well tubing may be the operating string to take the tool 110 down within casing. In open hole conditions where there is no casing in the well, the tool may be adapted to be connected to the lower end of drill collars by the conventional tapered threads of drill pipe.

The tool 110 is usually operated in conjunction with a conventional well jar such as shown in the prior art.

Above the well jar is generally one or more sections of sinker bar or drill collars to provide mass for inertia. Above the mass is a jar accelerator tool which may be conventional, or the new type such as shown in Ser. No. 217,447, filed July 11, 1988.

The tool 110 is brought down into the fish 146 until the spacer collar 138 is in contact with the fish. Additional weight is then put down on the tool 110 to move the cam guide 120 as above described. The tool 110 is then raised slightly. The lowering and raising permits the internal ratchet to operate and to cause the fingers 142 to extend into the taper of the bowl 138 and grip the pipe firmly so that the fish can be hoisted up and removed from the well.

If for some reason the fish 146 does not readily come out in response to pulling on the fish by the tool 110, the tool may again be lowered to permit the spacer collar 138 to actuate the internal ratchet to cause the ratchet to remain in its lower position and release the fingertips 136 from the inner wall of the fish.

In some instances, it is desirable for the tool 110 to be equipped with the fluid seal extension 144A and the packer cup 152 to permit pumping of fluids down through the tool 110 and into the fish. Under some conditions the fluid pumped into the fish causes fluid circulation around the fish and facilitates its removal.

It is apparent that various modifications and changes may be made to the ratcheting fishing tools as disclosed without departing from the spirit of the invention or from the scope of the appended claims.

I claim:

1. A well fishing tool comprising:

(a) a generally cylindrical tool body connected with and enclosing a ratcheting means, an operating shaft mounted to reciprocate with respect to said body and connected to said ratcheting means, and a well fish grappling means having a first element connected with said tool body and a second element connected with said operating shaft, said grappling means operating to grasp a fish with said operating shaft being in a first axial position with respect to said tool body and to be free of said fish with said operating shaft being in a second axial position with respect to said tool body, said ratcheting means being adapted to be successively moved axially with each successive movement rotating a rotary ratchet member to retain said operating shaft alternately in said first axial position and in said second axial position;

(b) wherein said ratchet member comprises: a plurality of ratchet splines comprising a plurality of spline teeth with spline ramps and spline faces defined about an outer radius of said ratchet member; and a plurality of ratchet teeth, each comprising a sliding ramp and a stop face, said ratchet teeth defined in a circular set about an inner radius relative to and coincident with said spline teeth;

(c) a cam guide member comprising a plurality of axially aligned cam splines comprising cam spline teeth with cam spline ramps and cam spline faces defined about an outer radius of said cam guide member; and a plurality of cam teeth, each comprising a sliding ramp and a stop face, said cam teeth defined in a circular set about an inner radius relative to and coincident with said spline teeth;

(d) said cam teeth and said ratchet teeth being adapted to successively mesh together as said ratchet member is being advanced around said guide member and said ratchet spline teeth being adapted to be aligned with said cam spline teeth with each alternate advancement of said ratchet teeth with respect to said cam teeth;

(e) a cam body member forming body teeth with body ramps and body faces and spline grooves disposed alternately between said body teeth and having groove faces corresponding with said body faces;

(f) said cam splines being respectively fitted into said body spline grooves to a depth causing said cam spline ramps to form an extension of said body ramps and operating to hold said ratchet spline teeth in said first axial position when said ratchet spline teeth are registered with said cam spline teeth and in said second axial position when said ratchet spline teeth are out of registry with said cam spline teeth;

(g) flexible spring means being adapted to maintain and return said guide cam to said operating first position each time said operating shaft is moved form said first position to a second position;

(h) said ratchet spline teeth sliding along both said cam spline teeth and said body teeth and alternately along only said body teeth responsive to alternate axial movements between said first position and said second position.

2. The fishing tool of claim 1 wherein said first element connected to said housing is a grapple body forming a lower internally tapered bowl, and said second element connected to said operating shaft is a collet having a plurality of grapple fingers formed with an external taper and operating to close said fingers to grasp said fish when lowered into said internal taper and to be free of said fish when raised out of said internal taper.

3. The fishing tool of claim 2 additionally including a fluid packer means connected to said housing and extendable around said fish to establish a seal for fluids passing through said fishing tool into said fish.

4. An overshot well fishing tool comprising:

(a) a generally cylindrical tool body connected with and enclosing a ratcheting means, an operating shaft mounted to reciprocate with respect to said body and connected to said ratcheting means, and a well fish grappling means having a first element connected with said tool body and a second element connected with said operating shaft;

(b) said grappling means operating to grasp a fish with said operating shaft being in a first axial position with respect to said tool body and to be free of said fish with said operating shaft being in a second axial position with respect to said tool body;

(c) said ratcheting means being adapted to be successively moved axially with each successive movement rotating a rotary ratchet member to retain said operating shaft alternately in said first axial position and in said second axial position; and further comprising:

(1) wherein said ratchet member comprises: a plurality of ratchet splines comprising a plurality of spline teeth with spline ramps and spline faces defined about an outer radius of said ratchet member; and a plurality of ratchet teeth, each comprising a sliding ramp and a stop face, said ratchet teeth defined in a circular set about an inner radius relative to and coincident with said spline teeth;

(2) wherein a cam guide member comprising a plurality of axially aligned cam splines comprising cam spline teeth with cam spline ramps and cam spline faces defined about an outer radius of said cam guide member; and a plurality of cam teeth, each comprising a sliding ramp and a stop face, said cam teeth defined in a circular set about an inner radius relative to and coincident with said spline teeth;

(3) said cam teeth and said ratchet teeth being adapted to successively mesh together as said ratchet member is being advanced around said guide member and said ratchet spline teeth being adapted to be aligned with said cam spline teeth with each alternate advancement of said ratchet teeth with respect to said cam teeth;

(4) a cam body member forming body teeth with body ramps and body faces and spline grooves disposed alternately between said body teeth and having groove faces corresponding with said body faces;

(5) said cam splines being respectively fitted into said body spline grooves to a depth causing said cam spline ramps to form an extension of said body ramps and operating to hold said ratchet spline teeth in said first axial position when said ratchet spline teeth are registered with said cam spline teeth and in said second axial position when said ratchet spline teeth are out of registry with said cam spline;

(6) flexible spring means being adapted to maintain and return said guide cam to said operating in first position each time said operating shaft is moved from said first position to a second position;

(7) said ratchet spline teeth sliding along both said cam spline teeth and said body teeth and then along only said body teeth responsive to alternate axial movements between said first position and said second position;

(d) said first element connected to said housing being a grapple body forming a lower internally tapered bowl; and, (e) said second element connected to said operating shaft being a collet having a plurality of grapple fingers formed with an external taper and operating to close said fingers to grasp said fish when lowered into said internal taper and to be freed of said fish when raised out of said internal taper.

5. The fishing tool of claim 4 additionally including a fluid packer means connected to said housing and extendable around said fish to establish a seal for fluids passing through said fishing tool into said fish.

6. A spear well fishing tool comprising:

(a) a generally cylindrical tool body connected with and enclosing a ratcheting means, an operating shaft mounted to reciprocate with respect to said body and connected to said ratcheting means, and a well fish grappling means having a first element connected with said tool body and a second element connected with said operating shaft;

(b) said grappling means operating to grasp a fish with said operating means being in a first axial position with respect to said tool body and to be free of said fish with said operating shaft being in a second axial position with respect to said tool body;

(c) said ratcheting means being adapted to be successively moved axially against a compressive spring return with each movement rotating a rotary ratchet member to retain said operating shaft alternately in said first axial position and in said second axial position; and further comprising:

(1) wherein said ratchet member comprises: a plurality of ratchet splines comprising a plurality of spline teeth with spline ramps and spline faces defined about an outer radius of said ratchet member; and a plurality of ratchet teeth, each comprising a sliding ramp and a stop face, said ratchet teeth defined in a circular set about an inner radius relative to and coincident with said spline teeth;

(2) a cam guide member comprising a plurality of axially aligned cam splines comprising cam spline teeth with cam spline ramps and cam spline faces defined about an outer radius of said cam guide member; and a plurality of cam teeth, each comprising a sliding ramp and a stop face, said cam teeth defined in a circular set about an inner radius relative to and coincident with said spline teeth;

(3) said cam teeth and said ratchet teeth being adapted to successively mesh together as said ratchet member is being advanced around said guide member and said ratchet spline teeth being adapted to be aligned with said cam spline teeth with each alternate advancement of said ratchet teeth with respect to said cam teeth;

(4) a cam body member forming body teeth with body ramps and body faces and spline grooves disposed alternately between said body teeth and having groove faces corresponding with said body faces;

(5) said cam splines being respectively fitted into said body spline grooves to a depth causing said cam spline ramps to form an extension of said body ramps and operating to hold said ratchet spline teeth in said first axial position when said ratchet spline teeth are registered with said cam spline teeth and in said second axial position when said ratchet spline teeth are out of registry with said cam spline teeth;

(6) flexible spring means being adapted to maintain and return said guide cam to said operating first position each time said operating shaft is moved from said first position to a second position;

(7) said ratchet spline teeth sliding along both said cam spline teeth and said body teeth and alternately along only said body teeth responsive to alternate axial movements between said first position and said second position;

(d) said fish grappling means having a slip finger element connected to said housing and expansion cone element connected to said shaft; and, (e) said grappling device operating to grasp a fish internally with said housing being in a first axial position with respect to said shaft and to be free of said fish with said housing being in a second axial position with respect to said shaft.

7. The fishing toll of claim 6 additionally including a fluid packer means connected to said expansion cone element and extendable into said fish to establish a seal for fluids passing through said fishing tool into said fish.

* * * * *